United States Patent [19]

Augenstein et al.

[11] 4,080,900

[45] Mar. 28, 1978

[54] PROJECTILE

[75] Inventors: Bruno W. Augenstein; Charles B. Dougherty, both of Santa Monica, Calif.

[73] Assignee: The Rand Corporation, Santa Monica, Calif.

[21] Appl. No.: 197,264

[22] Filed: Nov. 24, 1950

[51] Int. Cl.[2] ..... F42B 13/48

[52] U.S. Cl. ..... 102/67

[58] Field of Search ..... 102/67, 68, 63, 64, 102/89

[56] References Cited

U.S. PATENT DOCUMENTS

| | | | |
|---|---|---|---|
| 1,297,873 | 3/1919 | Laurie | 102/63 |
| 1,305,967 | 6/1919 | Hawks | 102/67 |
| 1,325,706 | 12/1919 | Todisco | 102/67 |
| 2,373,364 | 4/1945 | Wellcome | 102/63 |

FOREIGN PATENT DOCUMENTS

| | | | |
|---|---|---|---|
| 550,001 | 12/1942 | United Kingdom | 102/67 |

*Primary Examiner*—Verlin R. Pendegrass
*Attorney, Agent, or Firm*—Fulwider, Patton, Rieber, Lee & Utecht

EXEMPLARY CLAIM

1. A projectile comprising a nose section having a central core extending backward therefrom, said core having a cylinder in the tail end thereof adapted to receive a piston, a tail section having a central core extending forward therefrom, the front end of said core carrying a piston adapted to fit within said cylinder, an explosive charge within said cylinder operatively connected to a fuse carried by said projectile, said piston being within said cylinder so that upon explosion of said charge, said piston and cylinder are forced apart to separate said nose section and said tail section, a bundle of rods extending between said nose section and said tail section arranged about said central cores, and projections on each end of each rod engaging with corresponding depressions in said nose section and said tail section respectively for holding said rods in position until said charge is detonated and said sections are separated.

6 Claims, 6 Drawing Figures

BRUNO W. AUGENSTEIN &
CHARLES B. DOUGHERTY,
INVENTORS.

BY Gerald W. Peterson

ATTORNEY.

PROJECTILE

This invention relates to a projectile. More particularly it relates to a projectile especially useful for anti-aircraft artillery.

The usual projectile for anti-aircraft designed primarily for fragmentation effect, obtained through dispersion of the fragments at high velocity by an explosive charge in the projectile is a typical streamlined, point-fuzed high explosive shell having fairly thick walls and a relatively large volume of bursting charge. Such a fragmentation projectile is usually adapted to be set off by a fuze located in the point, such as a time fuze or a proximity fuze, so that the exploding charge will break the body portion into fragments which by the burst of the charge are dispersed at high velocity against a target.

My invention provides a projectile in which, at the proper time by an appropriate fuze such as a time fuze or proximity fuze, a bundle of rod-like elements is dispersed so that the rod-like elements in dispersing travel toward the target in a path describing a cone. These rod-like elements are far more effective than the relatively small randomly formed fragments obtained by conventional fragmentation warheads, and increase the single shot kill probability of anti-aircraft artillery particularly against aircraft of the heavy bomber type. The rod-like elements of my invention tend to move broadside relative to the wind and do a surprising amount of damage as, for example, by severing main spars, causing uncontrollable fires from many firings against fuel tanks, even self-sealing, "mashing" engines, and clipping propellers and tail surfaces. With projectiles of my invention it is probable that as high as about 30 percent of the presented area of a conventional aircraft might be considered as vulnerable area.

In accordance with the projectile of my invention the body portion comprises essentially a bundle of nested rods substantially longitudinally disposed which at the appropriate time in flight are adapted to be dispersed by the centrifugal effect of the customary rotation of the projectile about its axis in flight. The projectile of my invention does not require a large quantity of explosive charge to produce fragments but may use only a sufficient charge to cause a release of the bundle of rods. This makes it possible to provide a projectile in accordance with my invention having a substantially higher density, which gives in turn a substantial increases in balistic efficiency. More particularly, this is accomplished by fixing the ends of the rods to the front portion, nose section and back portion or tail section respectively of the projectile and releasing the rods at the appropriate time in flight as by a relatively small explosive charge by separating the back and front portion from one another along the axis and thus releasing the rotating bundle of rods which then break a circular band about the bundle by centrifugal force so that the rods travel thereafter in a conical formation towards the target.

The projectile of my invention uses long rodlike elements as fragments which are preformed. These rodlike elements are far more effective than the small randomly formed fragments which are obtained by conventional fragmentation warheads. Because the rods can be dispersed mainly by centrifugal force, the blast charge required is very low. The projectile thus can be made to have almost the density of a solid metal shell.

This means that the aerodynamic retardation is much less than that of the projectiles of the prior art and consequently the time of flight is less. The rods, since they are preformed, give fragments of uniform predetermined size and shape, and can be made as nearly optimum as possible consistent with design limitations.

The time of flight of this shell are less than those of the standard 120mm shell. For example, the 2 3/4 inch sabot shell with rod-fragments, fired from the present day 120mm gun with the identical charge of present shells, has a time of flight of 26.9 seconds to 20,000 yards with an initial velocity of 3,100 ft/sec. To achieve this same performance with the present prior art shell would require an initial velocity of 4,400 ft/sec. Briefly, the rods are placed in a compact bundle as high a packing density as possible, bearing in mind that the dispersal of the rods is effected mainly by the rotation of the shell.

The rods are pre-machined to the desired shape and size. The cross-section of the rod may be roughly triangular, and the rods may be arranged in concentric layers. The triangular rods permit easier separation of the rods, and may also have lower slowdown and better target destructiveness. The rods may have small lugs on the ends to fit into recesses in the nose and base of the shell.

The shell, exclusive of the rods, is designed in two major pieces: a base which has a central core ahead of it, and a nose which has a central core behind it. The two parts of the central core meet in a piston-cylinder juncture, with the volume of the cylinder filled with the detonating charge which is used to separate the rods. Near the two ends of the central core, ridges are machined which mesh with small holes on the inner side of the innermost layer of rods. These ridges are so designed as to hold the shell together under tensile, handling stresses and any tensile stresses after shell ejection from the gun. They are, however, to be sheared off when the detonating charge is set off.

The projectile of my invention can be fired from the present 120mm guns with the same propelling charge, gun barrell and recoil devices. This is done by propelling the shell with a sabot which is dropped after the shell is ejected from the barrell. The sabot is 120mm in diameter; it may be dropped by one of several conventional ways, such as by spring action or by centrifugal force and axial release with breakup. The sabot has lugs which fit into recessions in the shell; these lugs serve to hold the sabot and shell together and to transmit forces between the shell and sabot.

My invention will be particularly illustrated and described by reference to the drawing in which.

Figure 1:
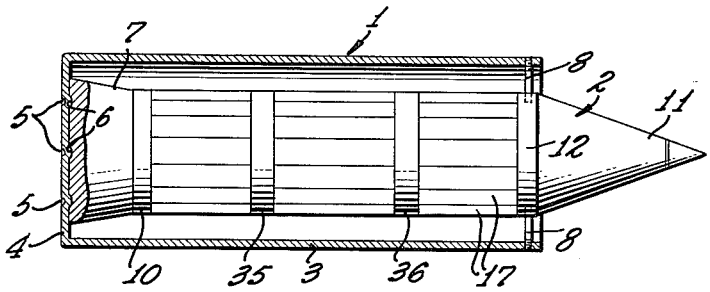
FIG. 1 shows a projectile in accordance with my invention held within a conventional sabot.

Referring particularly to FIG. 1, at 1 is shown a conventional sabot holding a projectile shown generally at 2 in accordance with my invention. The sabot comprises a cylindrical casing 3 having a back portion 4 the interior of which carries lugs or projections 5 adapted to engage depression 6 in the back portion 7 of the projectile so that the projectile when being fired with a sabot is rotated in the customary manner. At 8 are showing means on the sabot for holding the projectile in position as is customary.

The projectile of my invention comprises essentially a back portion on tail section shown in the drawing as consisting of central core or piston member 9, washer member 10 and tail locking nut 7, and front portion or nose section shown as consisting of point 11, which will carry the desired fuze (not shown), washer 12, and central core or rod 13 having cylinder 14 in one end thereof into which piston 15 is adapted to fit. Cylinder 14 carries a relatively small explosive charge 16 which when exploded forces a separation of the back portion from the front portion.

Figure 4:
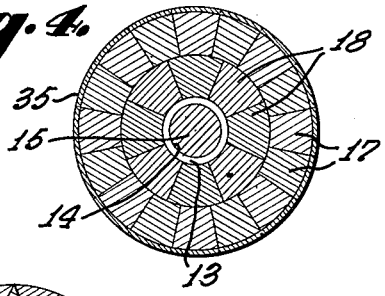
FIG. 4 is a cross section on the line 4—4 of FIG. 2.

Between the back portion and front portion of the projectile and extending around the central core 9 and 13 are rod-like elements 17 and 18, there being shown sixteen of the rod-like elements 17 on the periphery or outer circle and eight of the rod-like elements 18 in the inner circle, as particularly shown in FIG. 4.

Each of the rod-like elements 18 has at its forward portion a depression 19 adapted to fit snuggly over ridge 20 on central rod 13 and the back portion of each rod 18 has a similar depression 21 adapted to fit snuggly over ridge 22 on central rod 9. Rods 18 at their forward end each carry lugs or projections 23 adapted to fit snuggly into depressions 24 in washer 12. The back ends of rod 18 carry projections 25 adapted to fit in depressions 26 on washer 10. Rods 17 at their forward ends carry projections 27 adapted to fit snuggly within depressions 28 carried by washer 12 and rods 17 at their back ends carry projections 29 adapted to fit within depressions 30 carried by washer 10. Instead of ridges 20 and 22, piston member 15 may be threaded into cylinder 14 (not shown) and these threads stripped by the charge 16 instead of stripping ridges 20 and 22.

Point 11 has screw threads 31 adapted to mesh with screw threads 32 and central rod 13 so that point 11 may be screwed down against washer 12 to hold it firmly in position. Tail nut 7 has screw threads 33 adapted to mesh with screw threads 34 on the back end of central rod 9 so that nut 7 may be turned tightly against washer 10 to hold it firmly in position.

Figure 3:
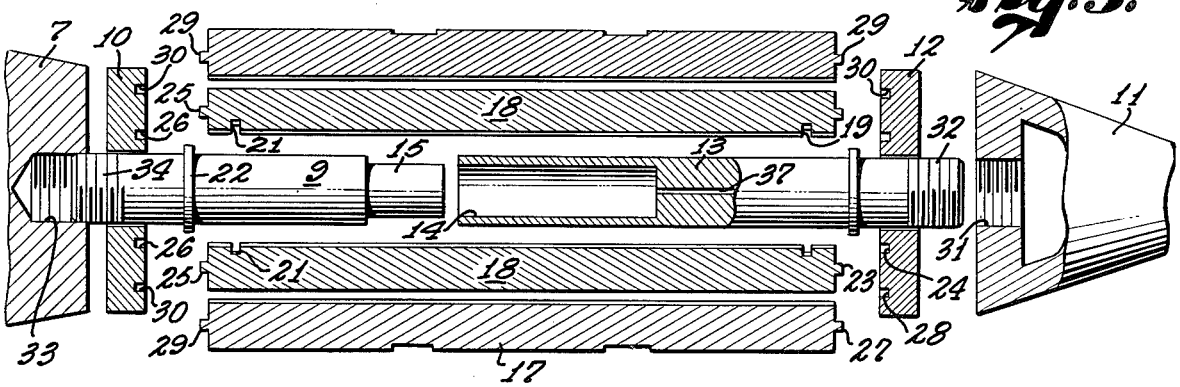
FIG. 3 shows an expanded view of FIG. 2, particularly showing the relationship of the various elements separated one from another.

In accordance with this arrangement, this projectile of my invention may be assembled as indicated best by reference to FIG. 3, by first filling cylinder 14 with the proper charge of explosive 16 and placing piston 15 thereagainst within cylinder 14 so that depressions 19 of rods 18 are fitted onto ridge 22. This places the charge 16, piston 15 and cylinder 14, front central rod 13 and back central rod 9, and the eight rods 18 in position. The sixteen rods 17 are then placed about the cylinder formed by the eight rods 18, and about the cylinder formed by the sixteen rods 17 is then placed two metal bands 35 and 36 to hold the whole set of rods in position against ordinary outward movement. Washer 12 may then be moved toward rods 17 and 18 so that the projections 23 of rods 18 and 27 of rods 17 fit respectively into depressions 24 and 28 of washer 12. Point 11 is then screwed down onto washer 12 to hold it tightly in position. Washer 10 is then moved toward rod 17 and 18 so that projections 25 of rods 18 and 29 of rods 17 fit respectively into projections 26 and 30 of washer 10. Back nut 7 is then screwed against washer 10 to hold it firmly in position.

Running from the usual fuze in point 11 is power line 37 to set off charge 16 in an appropriate manner from the fuze in the point 11. It will of course be understood by those skilled in the art that charge 16 may be set off in any appropriate manner as, for example, by a time or proximity fuze located at any suitable position on or within the projectile.

In use a projectile of my invention would be shot or projected in the usual manner by means of a sabot which causes the high speed rotation of the projectile with the sabot being dropped from the projectile shortly after leaving the antiaircraft artillery. Upon a signal from the fuze which starts a propagation along the lead 37 the charge 16 is detonated. Since the resistance along the longitudinal axis is made less than in any other direction, the action of the detonated charge will be to push backward on piston 15 and forward on central rod 13 to effect a separation of the forward positions and the backward portions of my projectile, the piston cylinder combination simply sliding apart and the ridges 20 and 22 being sheared off. The charge must be strong enough so that the ridges 20 and 22 are sheared off; that is, the charge must be strong enough and the ridges weak enough so that separation will take place. These ridges 20 and 22 hold the nose and tail sections of my projectile together against tension loads. Once these ridges 20 and 22 have been sheared, the two sections continue to slide apart. When the nose and tail sections have been forced sufficiently far apart lugs 23, 27, 25 and 29 are released from washers 12 and 10 so that the rods are then completely freed from the nose and tail sections and the only thing holding them nested together at this moment are bands 35 and 36. These bands 35 and 36 are designed to be only strong enough to help hold the rods in position during handling and firing the projectile but weak enough to break under the centrifugal force of the rods when the rods are free of washer 10 and 12 as described above. Since the projections or lugs 23, 27, 25 and 29 are no longor carrying any of the centrifugal load of the rods, the full centrifugal load is placed on the restraining bands 35 and 36 and these bands, having been purposely weakened to fail to withstand this full centrifugal load, burst so that the rods then disperse in a substantially conical path of flight. Since the separation of the tail and nose section of the projectile caused by the detonation of charge 16 takes place almost instantaneously, the detonation of charge 16 will also aid in bursting the bands 35 and 36.

A projectile in accordance with my invention may, for example, be about 3 inches in diameter and may be saboted for firing from a 120mm gun. It may contain 24 steel rods as shown in FIG. 4 with each rod 13 inches long and weighing 0.75 lbs. Assuming for example a B-29 Bomber as a target with a slant range from the gun of 36,000 feet, an altitude of 25,000 feet, and a shell trajectory direction under the nose of the target, the terminal velocity of the shell would be approximately 2,000 ft/sec. Since the speed of a B-29 is roughly 500 ft/sec., the relative shellplane velocity is about 2,300 ft/sec. Thus the relative velocity is adequately high and only a small burst velocity is necessary to disperse the rods. The peripheral velocity of the outside rods due to rotation of the projectile is about 150 ft/sec., and is large enough to provide the required dispersion so that the dispersion is brought about by centrifugal action. Centrifugal dispersion provides a range of lateral velocities (the peripheral velocity of a rod depends on its distance from the axis of the shell) and, consequently, spreads out the rod-fragment pattern in a desirable manner.

The rods are preferably equilateral triangles in cross-section of approximately $\frac{5}{8}$ inch sides, and about 13 inches long. The twenty-four rods weigh 18 lbs. the rest of the shell about 10–12 lbs. and the sabot about 10–15 lbs., a total of about 45 lbs. which is somewhat less than the usual fragmentation projectile. Because of this and with the use of the same powder charge for shooting the muzzle velocity is increased to 3,260 ft/sec. for a 45 lb. shell and to 3,410 for a 40 lb. shell as compared with only 3,100 ft/sec. for the usual fragmentation projectile, and the ratio of weight to frontal area (of the projectile) is increased with respect to the standard 120mm fragmentation shell and is 50 to 75 percent greater for the projectile of this invention.

Figure 2:
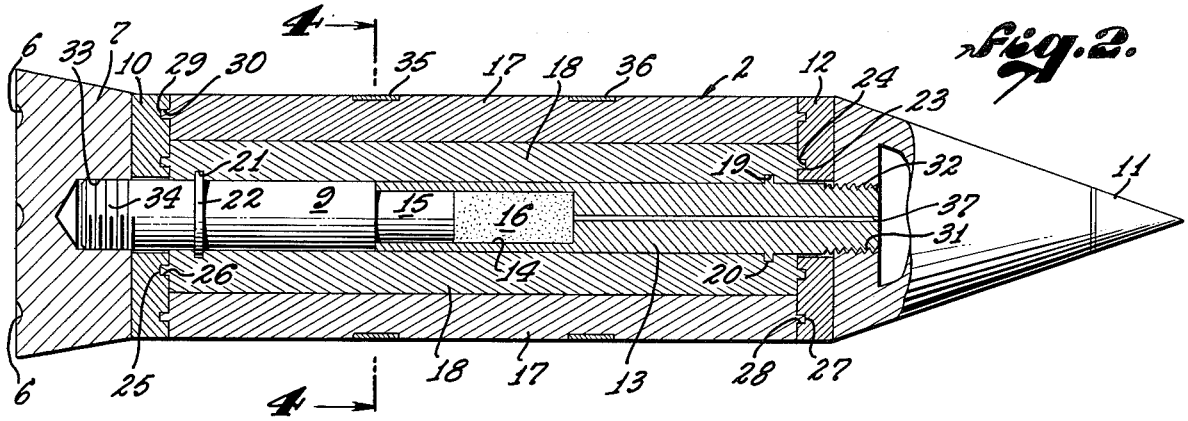
FIG. 2 shows a projectile in accordance with my invention, mostly in sections.
Figure 5:
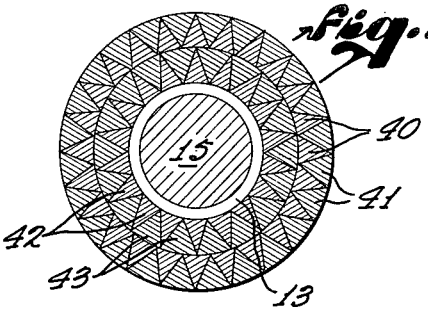
FIGS. 5 and 6 show modified cross-sections of rodlike elements in accordance with my invention.
Figure 6:
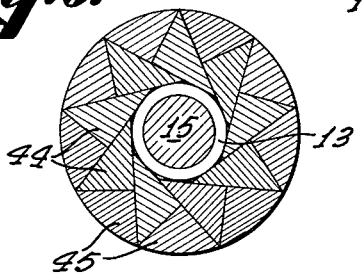

FIGS. 5 and 6 show a modified arrangement of rods. FIG. 5 shows an outer cylinder of rods triangular in cross-section with rods 40 having the apeces extending outwardly and rod 41 with the apeces extending inwardly. An inner cylinder of rods is made up of rods 42 triangular in cross-section with the apeces extending outwardly and rods 43 triangular in cross-section with the apeces extending inwardly. These rods would be assembled in the manner shown in FIGS. 2 and 3.

FIG. 6 shows a combination of rods 44 and 45 with rod 44 triangular in cross-section and rod 45 substantially triangular with one side curved as shown.

I claim:

1. A projectile comprising a nose section having a central core extending backward therefrom, said core having a cylinder in the tail end thereof adapted to receive a piston, a tail section having a central core extending forward therefrom, the front end of said core carrying a piston adapted to fit within said cylinder, an explosive charge within said cylinder operatively connected to a fuse carried by said projectile, said piston being within said cylinder so that upon explosion of said charge, said piston and cylinder are forced apart to separate said nose section and said tail section, a bundle of rods extending between said nose section and said tail section arranged about said central cores, and projection on each end of each rod engaging with corresponding depressions in said nose section and said tail section respectively for holding said rods in position until said charge is detonated and said sections are separated.

2. A projectile comprising: longitudinally spaced nose and tail sections of substantially equal diameter secured together by a reduced diameter central core to define an annular space surrounding said core between said sections; means defining a charge receiving cavity in said core intermediate the ends thereof, said core having a separable joint adjacent said cavity whereby an explosion in said cavity axially separates said sections; an explosive charge in said cavity operatively connected to fuse means carried by said projectile; a hollow bundle of rods substantially filling said annular space; and means at the junctures of said bundle and sections including longitudinally extending projections received in corresponding recesses at each end of said bundle to lock said rods to said sections until said sections are axially separated as aforesaid.

3. A projectile comprising: longitudinally spaced nose and tail sections of substantially equal diameter secured together by a reduced diameter central core to define an annular space surrounding said core between said sections; means defining a charge receiving cavity in said core intermediate the ends thereof, said core having a separable joint adjacent said cavity whereby an explosion in said cavity axially separates said sections; an explosive charge in said cavity operatively connected to fuse means carried by said projectile; a hollow bundle of rods substantially filling said annular space; and locking means on the ends of said bundle engaged with complemental means in said respective sections to lock said rods in position, said locking means being released upon axial separation of said sections to permit radial movement of said rods.

4. A projectile comprising: longitudinally spaced nose and tail sections of substantially equal diameter secured together by a reduced diameter central core to define an annular space surrounding said core between said sections; means defining a charge receiving cavity in said core intermediate the ends thereof, said core having a separable joint adjacent said cavity whereby an explosion in said cavity axially separates said sections; an explosive charge in said cavity operatively connected to fuse means carried by said projectile; a hollow bundle of rods substantially filling said annular space; locking means on the ends of said bundle engaged with complemental means in said respective sections to lock said rods in position, said locking means being released upon axial separation of said sections to permit radial movement of said rods; and core locking means at the juncture of at least one of the innermost of said rods and said core and positioned on both sides of said core joint, said core locking means including radial projections received in complemental recesses to hold said core against separation at said joint, said last named projections being frangible upon said explosion to permit separation of said core as aforesaid.

5. A projectile comprising: longitudinally spaced nose and tail sections of substantially equal diameter secured together by a reduced diameter central core to define an annular space surrounding said core between said sections, said core having a joint defining a transverse zone of weakness intermediate said sections; explosive means in said zone of weakness operatively connected to fuse means carried by said projectile to axially separate said core and sections when detonated; a hollow bundle of rods substantially filling said space, the ends of said bundle abutting opposed transverse surfaces of said respective sections; and locking means at said opposed surfaces including longitudinal projections and complemental recesses interengaging said rods with said sections to retain said rods against radial movement with respect to said core until said sections are separated as aforesaid.

6. A projectile comprising: longitudinally spaced nose and tail sections of substantially equal diameter secured together by a reduced diameter central core to define an annular space surrounding said core between said sections, said core having a joint defining a transverse zone of weakness intermediate said sections; explosive means in said zone of weakness operatively connected to fuse means carried by said projectile to axially separate said core and sections when detonated; a hollow bundle of rods substantially filling said space, the ends of said bundle abutting opposed transverse surfaces of said respective sections; locking means at said opposed surfaces including longitudinal projections and complemental recesses interengaging said rods with said sections to retain said rods against radial movement with respect to said core until said sections are separated as aforesaid; and at least two radial projections each received in a complemental recess, said radial projections being located in the juncture between said core and bundle on opposite sides of said zone of weakness and interengaging said bundle and core to normally prevent axial separation of said core, said projections being frangible by detonation of said explosive means to permit separation of said core as aforesaid.

* * * * *